United States Patent [19]

Binoche

[11] 4,055,300

[45] * Oct. 25, 1977

[54] EQUIPMENT FOR SPRAYING PAINT AND THE LIKE

[75] Inventor: Michel Binoche, Paris, France

[73] Assignee: SKM, Stains, France

[ * ] Notice: The portion of the term of this patent subsequent to Sept. 23, 1992, has been disclaimed.

[21] Appl. No.: 627,052

[22] Filed: Oct. 30, 1975

[30] Foreign Application Priority Data

Nov. 14, 1974 France ..... 74.37534
Mar. 10, 1975 France ..... 75.07362

[51] Int. Cl.[2] ..... B05B 5/02

[52] U.S. Cl. ..... 239/15; 239/296; 239/418

[58] Field of Search ..... 239/290, 292–300, 239/526, 527, 424.5, 426, 418, 599, 414, 15

[56] References Cited

U.S. PATENT DOCUMENTS

| | | | |
|---|---|---|---|
| 1,751,787 | 3/1930 | Binks | 239/299 |
| 2,235,708 | 3/1941 | Jenkins | 239/296 |
| 3,521,824 | 7/1970 | Wilcox | 239/424.5 |
| 3,773,263 | 11/1973 | Binoche | 239/296 X |
| 3,843,052 | 10/1974 | Cowan | 239/296 X |

*Primary Examiner*—John J. Love

[57] ABSTRACT

This equipment is of the type comprising a spray gun provided with a hydrostatic atomizing nozzle delivering a flat jet of liquid in combination with a pair of orifices disposed on either side of the nozzle and symmetrically in relation to the flat jet of liquid so as to deliver air jets in a plane perpendicular to that of the flat jet of liquid. The front surface of the nozzle is frustoconical and the two orifices are adapted to direct the air jets against said frustoconical surface and thus create two fan-shaped sheets of compressed air on either side of the flat jet of liquid also of fan-like configuration, said two fan-shaped sheets of compressed air being somewhat wider than the jet of liquid and meeting together at their edges while clamping said liquid jet. The equipment further comprises means for varying the pressure of the paint or other product from 5 to 30 bars (72.5 to 435 lbf) and the air jet pressure from 1 to 4 bars (14.5 to 58 lbf).

12 Claims, 13 Drawing Figures

EQUIPMENT FOR SPRAYING PAINT AND THE LIKE

BACKGROUND OF THE INVENTION

The applicant disclosed in various prior patents an equipment for atomizing paint or similar liquid products by the so-called "airless" method, and more particularly the atomizing nozzle of a spray gun delivering a flat jet of paint, which is remarkable notably in that it comprises means whereby an annular conical jet of air can be directed against the paint jet in close vicinity of the atomizing slot of the nozzle, in conjunction with a pair of additional jets of compressed air directed against the flat face of the paint jet.

The aforesaid patents also describe a spray nozzle of the type broadly set forth hereinabove which comprises a nozzle proper surrounded by an annular member of which the front frustoconical face constitutes an extension of the frustoconical side surface of the nozzle, said spray nozzle being capped in turn by an air outlet head adapted to form in conjunction with the frustoconical surfaces of said annular member and said nozzle an annular channel through which the jet of compressed air is delivered, said air outlet head having formed therethrough a pair of diametrally opposed channels supplied with compressed air with their outlet orifices disposed opposite said frustoconical surface of said annular member.

SUMMARY OF THE INVENTION

Now, according to the present invention, it was found that the manufacture of an atomizing or spray nozzle of this character could be simplified considerably while improving its operation and efficiency by eliminating the annular conical air jet and so disposing the pair of lateral jets of compressed air directed against said frustoconical surface as to combine their usual function with that of said annular conical air jet.

In fact, dispensing with the conical annular jet of compressed air simplifies considerably the manufacture of the spray gun nozzle in that several component elements are no more required; moreover, the absence of these unnecessary component elements clears the front portion of the spray gun nozzle, facilitates the drilling of channels delivering the pair of lateral jets of compressed air, and therefore permits of disposing these channels at the most suitable locations.

Comprehensive tests eventually proved that very satisfactory results could be obtained by causing the lateral air jets to be directed against the frustoconical surface of the nozzle body or its rearward extension, at a distance ranging from about 0.5 mm to 5 mm upstream of the nozzle orifice.

The vertex angle of the frustoconical nozzle surface of the frustoconical extension thereof may advantageously range from about 80° to about 110°.

To improve the atomization of the liquid product it may be necessary to slightly increase the air supply pressure of the lateral air jets in comparison with the pressure values usually applied when these jets were utilized in conjunction with conical annular jets, but in any case the "wrapping" of the atomized particles, the velocity thereof, and the automatic cleaning of the spray nozzle are at least similar to those obtained heretofore.

It may be assumed that these two lateral air jets symmetrical in a plane perpendicular to that of the fan-like sheet formed by the jet of paint create after bouncing on the impact area of the frustoconical surface a pair of fan-shaped sheets of compressed air wider than, and disposed on either side of, the paint sheet, said air sheets converging towards each other and enclosing, or so to say "clamping" the paint sheet, notably on the edges thereof, thus preventing "divergent horns" feared by the users from developing on either side of the paint sheet.

Since these two fan-shaped sheets of compressed air meeting to form a same and single sheet in the median plane of which the narrower paint sheet is atomized do not tend to reduce the width of this fan-like paint sheet thus "clamped" by the two sheets of compressed air, as observed when using the conical annular air jet, the pressure can be increased without any inconvenience.

The word "frustoconical" as used herein for designating the surface on which the lateral jets of compressed air are caused to rebound should not be taken in its strictly geometrical meaning, for it is intended to designate any surface departing more or less from a really conical surface, and notably a conical surface of circular cross-section, provided that it is capable of creating two fan-shaped and symmetrical sheets of compressed air.

It is particularly easy to form a frustoconical surface, but apparently it is only necessary that the cross-section of the surface on which the lateral jets of compressed air are projected be of regular closed-curve configuration and symmetrical in relation to the plane of the sheet of paint, and also to a plane perpendicular to this sheet and containing the axes of said lateral jets of compressed air, and sufficient to enable said surface to cause the compressed-air jets to rebound laterally and forwardly, on either side of the median plane containing said lateral jets, so as to gradually wrap up firstly this surface as it is struck by said jets and, beyond it, by said sheet of paint.

The coat of paint obtained with this spray gun is as thin as that obtained by means of a conventional pneumatic spray gun, and eliminates completely the paint mist due to the considerable air output necessary for causing the pneumatic atomization and the rebound thereof on the surface to be painted, which prevents the spray gun operation at abnormally short distances from said surface, as this would lead to considerable and expensive losses of paint, and would make working conditions rather unbearable.

The flexibility of use of the spray gun according to this invention is considerably greater than that of hydrostatic "airless" spray guns, due to the highly increased possibility of adjusting the paint output. Moreover, retouchings can be made in contrast to the technique using an airless hydrostatic spray gun which, on the other hand, cannot be used for painting at a very short distance from the surface to be coated.

Finally, the cleanliness of the nozzle and of the atomizing head assembly is improved to a substantial degree.

Now it was found that the quality of the paint coat obtained by using the device of this invention could be further improved while preserving the cleanliness of the nozzle and making substantial savings in actual service by using this spray gun in an equipment affording specific conditions of operation and by bringing minor modifications thereto.

This result may be achieved if the equipment for operating this spray gun comprises means for varying the pressure of the paint or other liquid product from 5 to 30 bars (72.5 to 435 lbf) and the air jet pressure from 1 to 4 bars (14.5 to 58 lbf). The paint output may also be adjusted without changing the nozzle, for example from 200 c.c./mm (12.2 cu.in./mm) to several multiples of this value. Another consequence of the arrangement according to this invention is that the use of nozzles having very small outlet orifices, i.e. liable to become occluded, is unnecessary at low paint outputs, in contrast to conventional hydrostatic atomization spray guns.

On the other hand, it was also found that the cleanliness of the nozzle and spray-gun head assembly, as well as the quality of atomization of the sheet of paint, could be improved considerably by so designing the spray gun that the lateral air jets impinging against the frustoconical surface be wider and have a stronger action in the central area of the jet of paint in comparison with the width and strength obtained with a single cylindrical hole, and more particularly by providing on either side two adjacent orifices producing parallel or slightly convergent air jets.

The spray gun of this invention may also in certain cases be completed by an arrangement enabling same to produce an electrostatic atomization.

BRIEF DESCRIPTION OF THE DRAWINGS

The attached drawing illustrates diagrammatically by way of example various possible forms of embodiment of this invention. In the drawing.

DESCRIPTION OF THE PREFERRED EMBODIMENT

Figure 1:
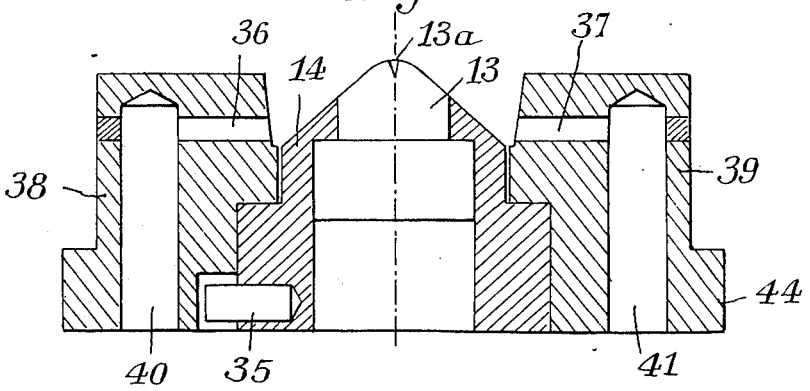
FIGS. 1 to 3 inclusive are axial sectional views showing on a large scale three different forms of embodiment of spray nozzles suitable for use in a spray gun equipment according to this invention.

The nozzle 13 formed with an axial hydrostatic atomizing slot 13*a* of conventional type opening at its spherical front end portion having a conical rear extension is secured within an annular member 14 set in the proper angular position by a pin 35.

A pair of lateral jets of compressed air directed normally to the fan-like sheet of paint sprayed through the atomizing slot 13*a* of nozzle 13 are formed through a pair of symmetrically aligned channels or passages 36, 37 drilled in a pair of bosses 38, 39 formed integrally with the air ring 44. At right angles to these channels or passages 36, 37 and opening into them are passages 40 and 41 for supplying compressed air thereto, the axes of the channels or passages 36 and 37 open into the space between the bosses 38, 39 and the outer surface of nozzle 13 set back about 3 mm (⅛ inch) from the front end of said nozzle 13.

Figure 2:
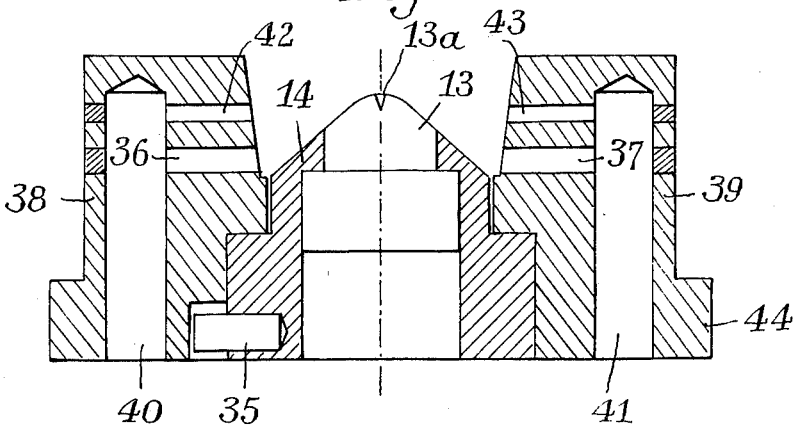

The form of embodiment illustrated in FIG. 2 differs from the one shown in FIG. 1 in that each lateral boss 38, 39 has formed therein a second lateral channel 42, 43 for delivering a jet of compressed air, this second lateral channel being disposed in the same axial plane as the preceding one 36, 37 and having a smaller diameter. Furthermore, this second channel 42, 43 is directed just behind the front end of the atomizing nozzle.

Figure 3:
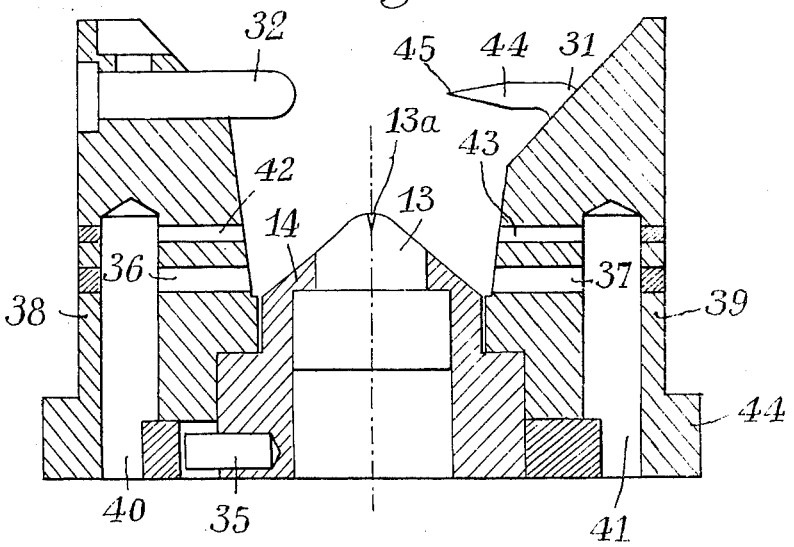

An equipment for the electrostatic atomization of paint may also be provided with an atomizing or spray nozzle of the types illustrated in FIGS. 1 and 2. However, as shown in FIG. 3, to prevent the channel 37 or both channels 37 and 43 from being coplanar with the primary electrode 31, this primary electrode 31 is off-set angularly on one or the other side of the second channel 41, and its tip 45 is directed not radially but in such a manner that it lies in the radial plane perpendicular to the plane containing the sheet of paint, the secondary electrode 32 and all the channels 36, 37 and 40 to 43, and that the discharge from the primary electrode 31 to the secondary electrode 32 be constantly perpendicular to the sheet of paint sprayed through the slot 13*a* of nozzle 13.

The spray nozzles illustrated in FIGS. 4 to 12 inclusive comprise a nozzle 1 for producing a hydrostatic atomization of paint or similar liquid product, i.e. a nozzle provided with an axial bore of very small diameter through which the liquid, notably paint under pressure, is delivered and emerges through a slot of dihedral configuration having its vertex located in an axial plane perpendicular to the plane of the Figure. The surface 2 bounding all these nozzles at the front are substantially frustoconical, possibly with a rounded tip. Disposed symmetrically in relation to the plane of the flat jet of liquid are a pair of bosses 3, 4 through holes 5 and 6 for delivering two symmetrical air jets directed against the front frustoconical surface 2 of the nozzle are formed with a view to create two sheets of compressed air widening in a fan-like fashion and surrounding the flat jet of liquid, also of fan-like configuration.

Figure 5:
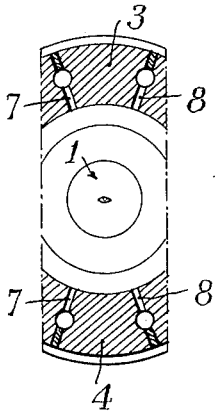
Figure 6:
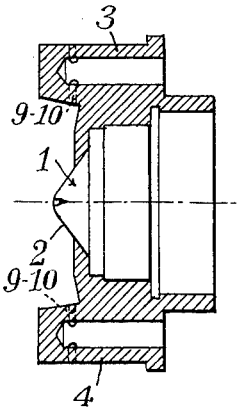
FIGS. 6 and 7 are similar views of a fifth form of embodiment.

In the form of embodiment illustrated in FIG. 5, each one of the two symmetrical air jets is divided in turn into two symmetrical jets in relation to an axial plane perpendicular to the plane of the flat jet of liquid. These air jets are slightly convergent and delivered from the pair of opposite passages 7 and 8.

Figure 7:
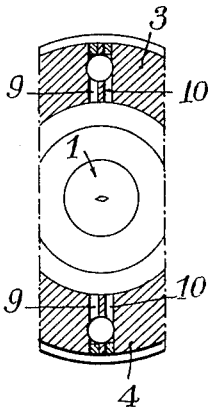

Definitely improved results were obtained by using two parallel jets disposed very close to each other and formed in channels such as 9 and 10 of FIG. 7.

Figure 8:
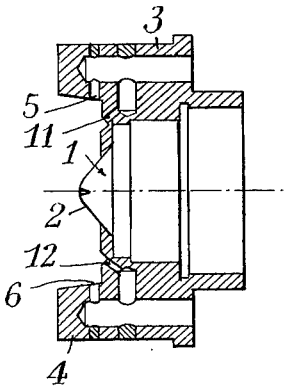
FIG. 8 is a longitudinal section showing a sixth form of embodiment of the invention.

Whatever the form of embodiment implemented in actual practice, one fraction of these lateral air jets may be deflected forwards by causing these jets to be struck before they impinge against the surface 2 of nozzle 1 by auxiliary inclined air jets fed through passages 11 and 12 disposed upstream of the jet orifices 5 and 6, as illustrated in FIG. 8.

Figure 9:
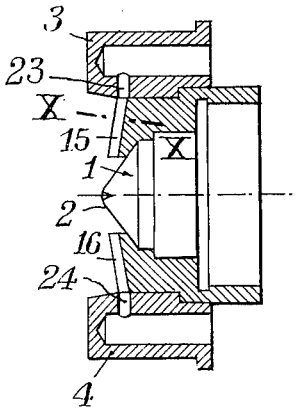
FIGS. 9 and 10 are a longitudinal section and a section taken along the line X—X of FIG. 9, respectively, showing a seventh form of embodiment of the invention.
Figure 10:
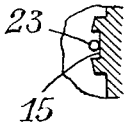

In an alternate form of embodiment illustrated in FIGS. 9 and 10, compressed air fed through bosses 3 and 4 escapes through radial passage sections 23, 24 opening into grooves 15 and 16 of substantially greater width and adapted to direct these air jets towards the surface 2 of nozzle 1. To improve the spreading of the jets of compressed air on the bottom of said grooves 15 and 16, this bottom may be more or less secant to the corresponding passage 23, 24 opening into said grooves, instead of being tangent thereto.

Figure 11:
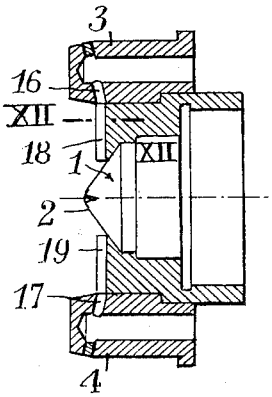
FIGS. 11 and 12 are a longitudinal section and a section taken along the line XII—XII of FIG. 11, respectively, of an eighth form of embodiment of this invention.
Figure 12:
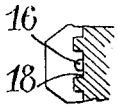

The form of embodiment illustrated in FIGS. 11 and 12 of the drawing departs from the preceding one shown in FIGS. 9 and 10 only in that the channels 16 and 17, instead of extending radially like passages 23 and 24, are slightly inclined to the rear, and that the grooves 18 and 19, instead of being slightly inclined towards the nozzle tip like grooves 15, 16, are disposed in a radial plane, at right angles to the nozzle axis.

Figure 4:
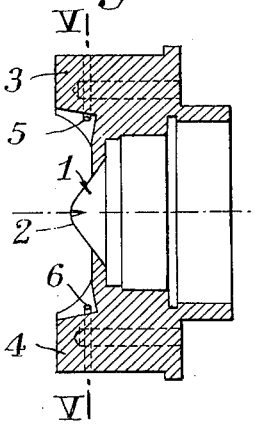
FIGS. 4 and 5 are sectional views showing on a smaller scale a longitudinal scale (FIG. 4) and in cross section take along the line V—V of FIG. 4 (FIG. 5) a fourth form of embodiment.
Figure 13:
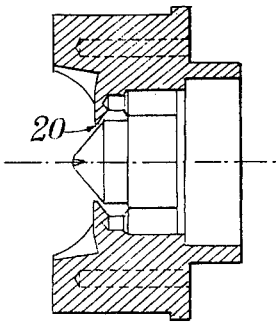
FIG. 13 is a longitudinal section showing a ninth form of embodiment of the invention.

FIG. 13 is a view similar to FIG. 4, except that the spray nozzle illustrated in FIG. 13 comprises an additional annular passage 20 for delivering an annular jet of compressed air to the nozzle in a manner known per se. In fact, although in most applications this contrivance is not attended by specific advantages, it is possible to complete all the forms of embodiments described hereinabove and illustrated in the drawing with passage means adapted to build up an annular jet of compressed air around the nozzle, provided of course that its output be relatively moderate to avoid any preponderant action thereof.

It will be readily understood by those conversant with the art that the various forms of embodiment described, illustrated and suggested herein should not be construed as limiting the scope of the invention since many modifications and variations my be brought thereto without departing from the basic principles of the invention as set forth in the appended claims. Thus, the passages or channels 36, 37 and 42, 43 of FIGS. 1 to 3, through which the lateral jets of compressed air are sprayed against the nozzle, are not compulsorily aligned but may be inclined forwardly and more or less outwardly.

What is claimed is:

1. Equipment for spraying paint or similar products comprising a spray gun comprising:

a. an atomizing nozzle adapted to project a flat fan-like jet of liquid, said nozzle having a frustoconical surface configuration with a vertex angle within the range of 80° to 110° with a front surface symmetrical in relation to the plane of said flat liquid jet and b. a pair of lateral jets of compressed air disposed symmetrically in relation to and directed towards said atomizing nozzle at points slightly sufficiently set back from the front end of the atomizing nozzle to create air sheets after rebounding from the nozzle surface which are coaxial to a jet of paint sprayed from said nozzle, said air jets meeting each other while clamping the sheet of paint sprayed from said nozzle.

2. Equipment according to claim 1 at which compressed air impinges on said nozzle at a point set back 0.5 to 3 mm from the nozzle outlet orifice.

3. Equipment according to claim 1, comprising a second pair of lateral jets of compressed air parallel to and disposed downstream of, the first pair of lateral jets of compressed air, so as to engage the nozzle surface just behind its outlet orifice.

4. Equipment according to claim 1, in that which the lateral jets of compressed air are inclined inwards towards the front end of the nozzle.

5. Equipment according to claim 1, designed for operating as an electrostatic spray gun equipment and in which the primary electrode is off-set angularly to prevent it from lying in the radial plane perpendicular to the sheet of atomized paint, the tip of said primary electrode being directed not radially but in such a manner that it lies in said plane and registers with the secondary electrode on the side of the atomizing nozzle opposite the side where the secondary electrode is located.

6. Equipment according to claim 1, comprising means for varying the pressure of the paint or other product from 5 to 30 bars.(72.5 to 435 lb) and the air jet pressure from 1 to 4 bars (14.5 to 58 lbf).

7. Equipment according to claim 1, in which the paint output is adjustable without changing the spray nozzle, for example from 200 c.c./mm (12.2 cu.in./mn) to a value several multiples thereof.

8. Equipment according to claim 1, in which the spray gun comprises on each side two continguous orifices delivering parallel air jets.

9. Equipment according to claim 1, characterized in which the spray gun comprises on each side two continguous orifices delivering two slightly convergent jets.

10. Equipment according to claim 1, in which said lateral air jets are delivered from the outlet orifices into grooves of greater width so disposed as to direct said jets towards the frustoconical surface of the nozzle.

11. Equipment according to claim 1, in which said lateral air jets are delivered from the outlet orifices into grooves of greater width so disposed as to direct said jets towards the frustoconical surface of the nozzle, and said grooves are flat-bottomed.

12. Equipment according to claim 1, in which the spray gun is so arranged that it can deflect one fraction of the compressed air of said lateral jets forwards by striking them, before they impinge against the nozzle surface, this deflection being obtained by providing auxiliary air jets delivered from passages disposed upstream of said outlet orifices.

* * * * *